US009899757B2

(12) United States Patent
Do

(10) Patent No.: US 9,899,757 B2
(45) Date of Patent: Feb. 20, 2018

(54) SURFACE CONNECTOR WITH SILICONE SPRING MEMBER

(71) Applicant: APPLE INC., Cupertino, CA (US)

(72) Inventor: Trent K. Do, Milpitas, CA (US)

(73) Assignee: APPLE INC., Cupertino, CA (US)

( * ) Notice: Subject to any disclaimer, the term of this patent is extended or adjusted under 35 U.S.C. 154(b) by 0 days.

(21) Appl. No.: 14/845,084

(22) Filed: Sep. 3, 2015

(65) Prior Publication Data

US 2017/0069995 A1 Mar. 9, 2017

(51) Int. Cl.
*H01R 24/00* (2011.01)
*H01R 13/42* (2006.01)

(52) U.S. Cl.
CPC ..... *H01R 13/42* (2013.01)

(58) Field of Classification Search
CPC ..... H01R 13/42
USPC ..... 439/66, 65, 626
See application file for complete search history.

(56) References Cited

U.S. PATENT DOCUMENTS 5,974,662 A * 11/1999 Eldridge ..... B23K 20/004 174/261
5,994,975 A * 11/1999 Allen ..... H01P 1/04 174/152 GM
6,615,485 B2 * 9/2003 Eldridge ..... B23K 20/004 257/E21.503
7,126,362 B2 * 10/2006 Yoshida ..... G01R 1/06772 324/756.03
7,282,378 B2 * 10/2007 Yoshida ..... G01R 1/045 257/48
7,372,286 B2 * 5/2008 Lee ..... G01R 1/07378 324/754.18
7,618,281 B2 * 11/2009 Eldridge ..... G01R 1/0466 439/482
7,632,106 B2 * 12/2009 Nakamura ..... G01R 1/0466 439/591
7,740,488 B2 * 6/2010 Taylor ..... H01R 12/714 439/66
7,816,932 B2 * 10/2010 Cartier, Jr. ..... G01R 1/06772 324/754.08
7,876,527 B2 * 1/2011 Nakamiya ..... G11B 25/043 360/97.22

(Continued)

OTHER PUBLICATIONS

Office Action dated May 9, 2017 in U.S. Appl. No. 15/274,176, 16 pages.

*Primary Examiner* — Tulsidas C Patel
*Assistant Examiner* — Peter G Leigh
(74) *Attorney, Agent, or Firm* — Kilpatrick Townsend & Stockton, LLP

(57) ABSTRACT

Contact structures for devices, where contacts in the contact structures provide a proper normal force while consuming a minimal amount of surface area, depth, and volume in a device and where the contact structures prevent or limit the ingress of fluid or debris into the device. On example may provide a contact structure having a frame. The frame may be arranged to be placed in an opening in a device enclosure for an electronic device or the frame may be part of the electronic device. The frame may include a number of passages, each passage for a contact of the contact structure. Each contact may be held to the frame by a pliable membrane. Each contact may connect to a board in the electronic device via a compliant conductive path.

27 Claims, 8 Drawing Sheets

(56) References Cited

U.S. PATENT DOCUMENTS

| | | | | |
|---|---|---|---|---|
| 7,950,927 | B2 * | 5/2011 | Kazama | G01R 1/0466 324/755.05 |
| 7,957,806 | B2 * | 6/2011 | Stevenson | H01G 4/40 361/302 |
| 8,098,454 | B2 * | 1/2012 | Kouno | G11B 33/1466 360/99.21 |
| 8,314,624 | B2 | 11/2012 | Kasukabe | |
| 9,039,448 | B2 * | 5/2015 | Mason | H01R 13/65807 439/607.09 |
| 9,048,042 | B2 * | 6/2015 | Steuer | H01R 13/5202 |
| 9,172,161 | B2 * | 10/2015 | Walden | H01R 12/714 |
| 9,252,513 | B2 * | 2/2016 | Masuda | H01R 12/714 |
| 2003/0022533 | A1 * | 1/2003 | Joo | G11B 5/4853 439/67 |
| 2006/0024988 | A1 * | 2/2006 | Eldridge | G01R 1/0466 439/66 |
| 2006/0066330 | A1 * | 3/2006 | Yoshida | G01R 1/06772 324/756.03 |
| 2008/0211525 | A1 * | 9/2008 | Garabedian | G01R 1/07378 324/756.03 |
| 2009/0097163 | A1 * | 4/2009 | Suzuki | G11B 33/1466 360/245.8 |
| 2010/0328815 | A1 * | 12/2010 | Nakatsuka | G11B 25/043 360/110 |
| 2011/0056731 | A1 * | 3/2011 | VandenEynden | H01B 17/30 174/152 GM |
| 2013/0063838 | A1 * | 3/2013 | Otake | G11B 25/043 360/97.12 |

* cited by examiner

SURFACE CONNECTOR WITH SILICONE SPRING MEMBER

BACKGROUND

The number of types of electronic devices that are commercially available has increased tremendously the past few years and the rate of introduction of new devices shows no signs of abating. Devices, such as tablet, laptop, netbook, desktop, and all-in-one computers, cell, smart, and media phones, storage devices, portable media players, navigation systems, monitors, and others, have become ubiquitous.

Power and data may be provided from one device to another over cables that may include one or more wire conductors, fiber optic cables, or other conductor. Connector inserts may be located at each end of these cables and may be inserted into connector receptacles in the communicating or power transferring devices. In other systems, contacts on the devices may come into direct contact with each other without the need for intervening cables.

In systems where contacts on two electronic devices come into contact with each other, it may be difficult to generate enough normal force to ensure a good electrical connections between contacts in the two devices. To provide a sufficient normal force, contacts may often have a substantial depth and consume a relatively large volume of space in the electronic device. The loss of this space may mean that the electronic device is either larger or only includes a reduced set of functionality.

Connector systems in general may inadvertently provide paths for the ingress of moisture, liquids, or other fluids. These connector systems may also provide pathways whereby external dust or particulate matter may reach an interior of an electronic device.

Thus, what is needed are contact structures for devices, where contacts in the contact structures provide a proper normal force while consuming a minimal amount of surface area, depth, and volume in a device and where the contact structures prevent or limit the ingress of fluid or debris into the device.

SUMMARY

Accordingly, embodiments of the present invention may provide contact structures for devices, where contacts in the contact structures provide a proper normal force while consuming a minimal amount of surface area, depth, and volume in a device and where the contact structures prevent or limit the ingress of fluid or debris into the device.

An illustrative embodiment of the present invention may provide a contact structure having a frame. The frame may be arranged to be placed in an opening in a device enclosure for an electronic device or the frame may be part of the electronic device. The frame may include a number of passages, each passage for a contact of the contact structure. Each contact may be held to the frame by a pliable membrane. Each contact may connect to a board in the electronic device via a compliant conductive path.

In these and other embodiments of the present invention, the frame may be formed of a liquid crystal polymer (LCP), glass-filled nylon, aluminum, ceramic, or other material. The pliable membrane may be formed of silicone, rubber, or other pliable material. The pliable membrane may be formed by insert molding or other appropriate method. At least one of the frame or pliable membrane may be nonconductive. The contacts may be copper, stainless steel, or other conductive material. The contacts may be circular, oval, square, or they may have another shape. The contacts may be formed by machining, stamping, or other appropriate method. The compliant conductive path may be a wire, spring, spring-loaded contact, and may be formed using copper, a copper-nickel alloy such as NKC388, or other material.

The contacts may be fixed in position in passages in the frames in various ways. In an illustrative embodiment of the present invention, a contact may be formed as a disk, where a circular outside edge of the disk is supported by a pliant membrane. The disk may have a notch in the circular edge. The pliant membrane may have a corresponding tab that fits into the notch in the side of the disk. In these and other embodiments of the present invention, the frame may have a similar notch in each passage and the pliant membrane may have a second tab fit into the frame notch. This arrangement may secure the contact to the frame and prevent the contact from being pushed out of the frame when contact is made with a second contact on a second electronic device. This arrangement may provide contacts having a minimal depth. These contacts may also consume a limited amount of surface area. The volume in a device that is consumed by these contacts may thus be limited.

The contacts may be fixed in position in passages in the frames in other ways as well. For example, a contact may have a wider top and a narrower lower or base portion. This may simplify manufacturing of the contact. The contact may then be held in place with a pliant membrane that has a narrower top portion and a wider base. The wider base may secure the contact to the frame and prevent the contact from being pushed out of the frame when contact is made with a second contact on a second electronic device.

In various embodiments of the present invention, the contact frames may be attached to a device enclosure for an electronic device in various ways. In an embodiment of the present invention, a frame may be attached to a device enclosure using an insert molded membrane. This insert molded membrane may hold the frame rigidly relative to the device enclosure. In another embodiment of the present invention, a frame may be attached to a device enclosure using a second pliable membrane. This may allow the contact structure to move relative device enclosure. Either the frame or the device enclosure, or both, may have a notch in a face at the frame-to-device interface. The insert molded membrane may have a tab in either or both of these notches. These tabs and notches may secure the frame to the device enclosure such that the frame is not pushed out of the device enclosure when contact is made with a second contact on a second electronic device. In other embodiments of the present invention, the frame may be formed as part of a device enclosure for an electronic device.

Embodiments of the present invention may provide contact structures that may be located in various types of devices, such as portable computing devices, tablet computers, desktop computers, laptops, all-in-one computers, wearable computing devices, cell phones, smart phones, media phones, storage devices, portable media players, navigation systems, monitors, power supplies, adapters, remote control devices, chargers, and other devices. These contact structures may provide pathways for signals and power compliant with various standards such as one of the Universal Serial Bus (USB) standards including USB Type-C, High-Definition Multimedia Interface® (HDMI), Digital Visual Interface (DVI), Ethernet, DisplayPort, Thunderbolt™, Lightning™, Joint Test Action Group (JTAG), test-access-port (TAP), Directed Automated Random Testing (DART), universal asynchronous receiver/transmitters (UARTs), clock signals, power signals, and other types of standard, non-standard, and proprietary interfaces and combinations thereof that have been developed, are being developed, or will be developed in the future. In one example, the contact structures may be used to convey a data signal, a power supply, and ground.

Various embodiments of the present invention may incorporate one or more of these and the other features described herein. A better understanding of the nature and advantages of the present invention may be gained by reference to the following detailed description and the accompanying drawings.

DESCRIPTION OF EXEMPLARY EMBODIMENTS

Figure 1:
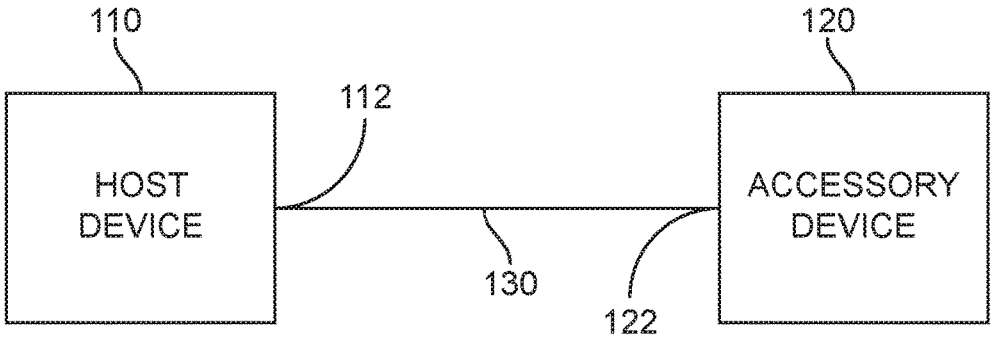
FIG. 1 illustrates an electronic system according to an embodiment of the present invention.

FIG. 1 illustrates an electronic system according to an embodiment of the present invention. This figure, as with the other included figures, is shown for illustrative purposes and does not limit either the possible embodiments of the present invention or the claims.

In this example, the host device 110 may be connected to accessory device 120 in order to share data, power, or both. Specifically, contacts 112 on host device 110 may be electrically connected to contacts 122 on accessory device 120. Contacts 112 on host device 110 may be electrically connected to contacts 122 on accessory device 120 via cable 130. In other embodiments of the present invention, contacts 112 on host device 110 may be directly and electrically connected to contacts 122 on accessory device 120.

To facilitate a direction connection between contacts 112 on host device 110 and contacts 122 on accessory device 120, contacts 112 may be part of a surface mount contact structure. An example of a surface mount contact structure that may include contacts 112 is shown in the following figure.

Figure 2:
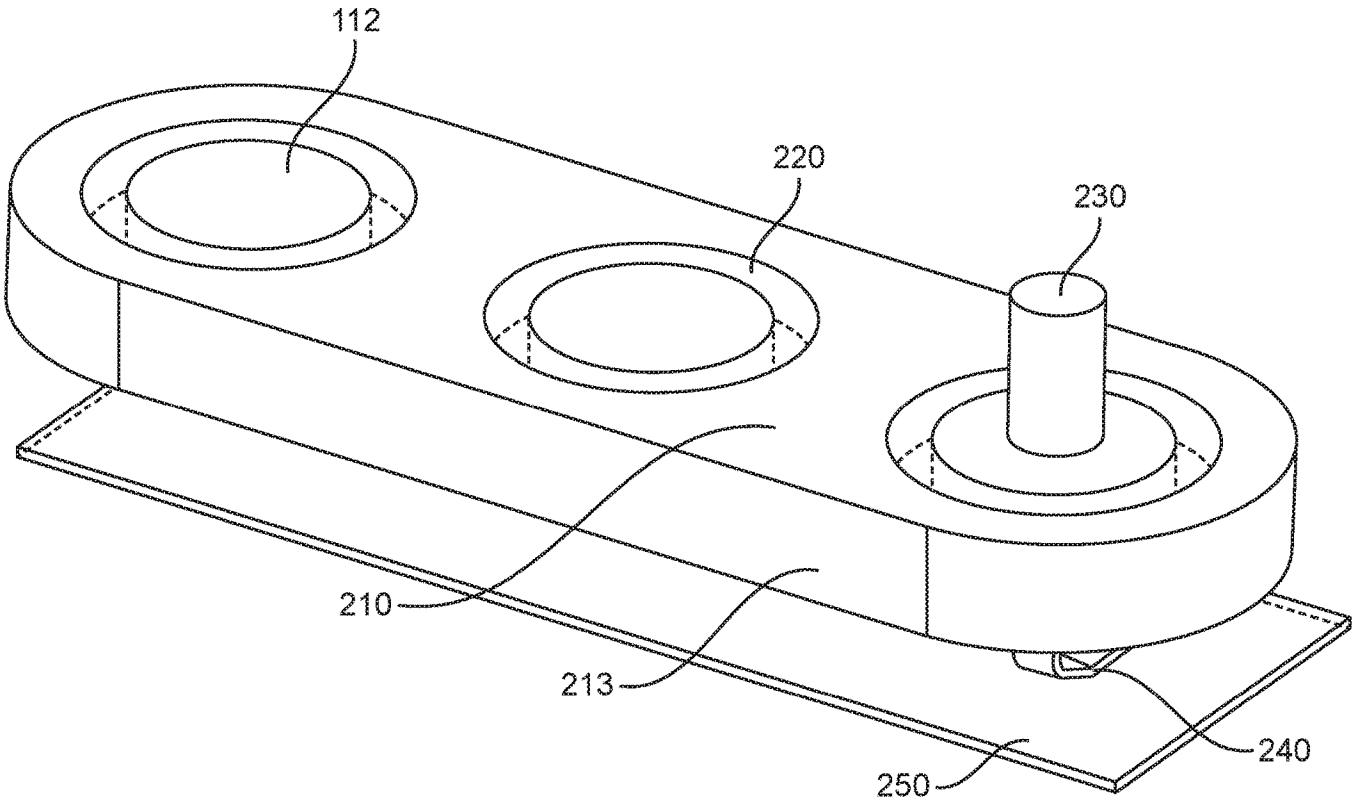
FIG. 2 illustrates a contact structure according to an embodiment of the present invention.

FIG. 2 illustrates a contact structure according to an embodiment of the present invention. This contact structure may include a frame 210 having an outside edge 213. Contacts 112 may be placed in passages in frame 210. Membranes 220 may hold contacts 112 in place in frame 210. Contacts 112 may electrically connect to traces (not shown) on a board 250 via compliant conductive paths 240.

In these and other embodiments of the present invention, frame 210 may be formed of a liquid crystal polymer (LCP), glass-filled nylon, aluminum, ceramic, or other material. Pliable membrane 220 may be formed of silicone, rubber, or other pliable material. Pliable membrane 220 may be formed by insert molding or other appropriate method. At least one of the frame 210 or pliable membrane 220 may be nonconductive. Contacts 112 may be copper, stainless steel, or other conductive material. Contacts 112 may be circular, oval, square, or they may have another shape. Contacts 112 may be formed by machining, stamping, or other appropriate method. The compliant conductive paths 240 may be wires, springs, spring-loaded contacts, and may be formed using copper, a copper-nickel alloy such as NKC388, or other material.

In this example, three contacts 112 are shown in a contact structure. In various embodiments the present invention, one contact may be used to convey a signal, one may be used to convey power, while another may be used for ground. Signals on a signal contact may be provided or received by an electronic device housing this contact structure. Power on a power contact may be provided or received by the electronic device housing this contact structure.

When corresponding contacts are brought into physical and electrical contact with contacts 112, pliable membrane 220 may deflect in response to an applied force, represented here as corresponding contact 230. This deflection may create a normal force in response to the force applied by corresponding contact 230.

As a force is applied by contacts 230, it may be desirable that contacts 112 are not pushed through frame 210. Accordingly, various features, such as interlocking features, may be used to hold contacts 112 in place in frame 210. An example is shown in the following figure.

Figure 3:
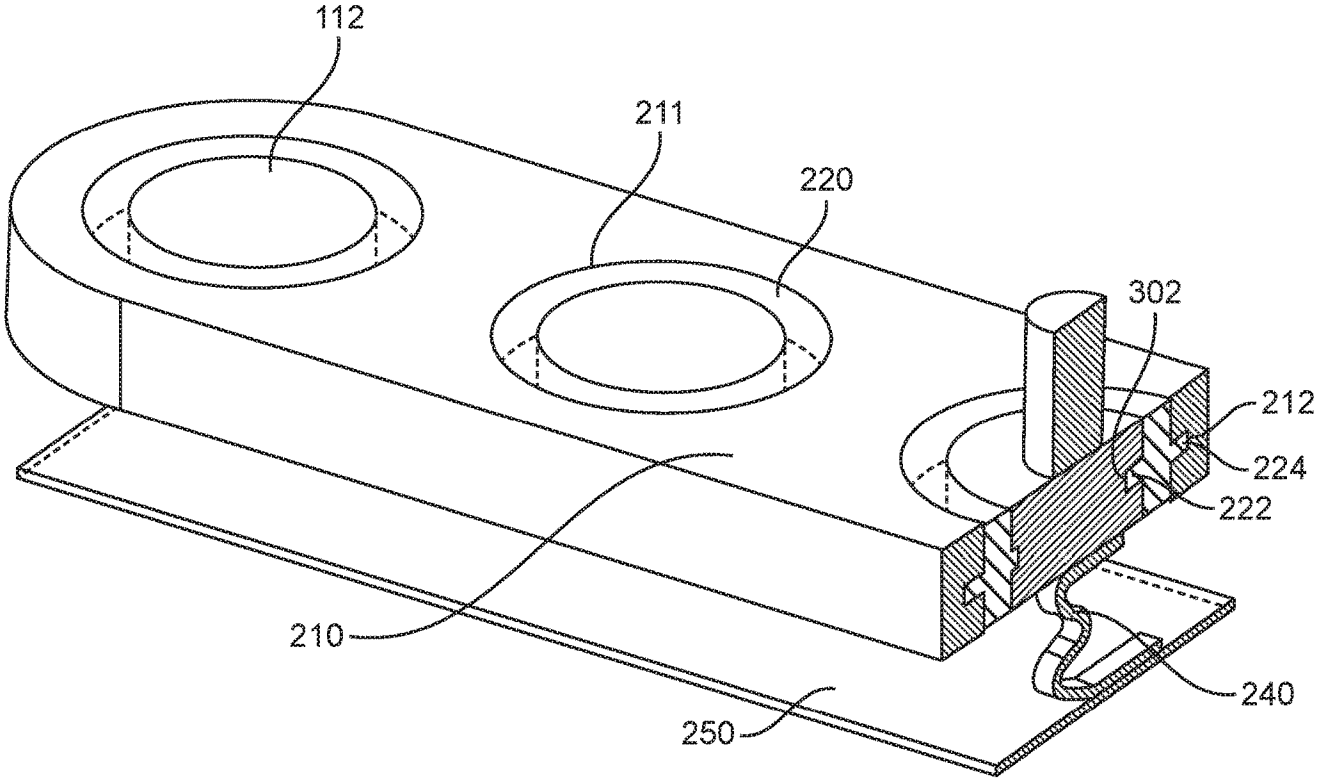
FIG. 3 illustrates an example of interlocking features that may be used to secure a contact in a frame of a contact structure according to embodiment of the present invention.

FIG. 3 illustrates an example of interlocking features that may be used to secure a contact in a frame of a contact structure according to embodiment of the present invention. Again, contacts 112 may be located in passages 211 in frame 210. The passages 211 may be formed as openings from a top side of frame 210 to a bottom side of frame 210. Contacts 112 may include notches 302. Pliable membrane 220 may include tabs 222 that fit in notches 302. These interlocking features may help to secure contacts 112 in place in pliable membrane 220. Notch 302 may be formed in an outside edge of contact 112. Notch 302 may be formed completely around contacts 112, or it may be limited to certain locations along an outside edge of contact 112.

Similarly, an inside edge of passage 211 may include notch 212. Pliable membrane 220 may include tabs 224 that fit in notches 212. Again, these interlocking features may help secure pliable membrane 220 in place in passages 211 of frame 210. Taken together, interlocking features including notches 302 and 212, and tabs 222 and 224, may secure contacts 112 in place in frame 210. Also, this configuration may help to prevent or reduce liquid or debris ingress into the electronic device housing this contact structure. As with notch 302, notch 212 may be located all the way around and inside edge of passage 211, or it may be limited to certain locations along the inside edge of passages 211 in frame 210.

This contact structure may be formed in various ways. For example, frame 210 may be formed. Contacts 112 may be formed, for example, by machining or stamping. Contacts 112 may be held in place in passages of frame 210 while silicone or other material is insert molded between contacts 112 and sidewalls of passages in frame 210. This arrangement may provide a contact having a limited footprint or surface area, as well as a limited depth. This combination may help to reduce a volume of a device consumed by this contact structure.

Figure 4:
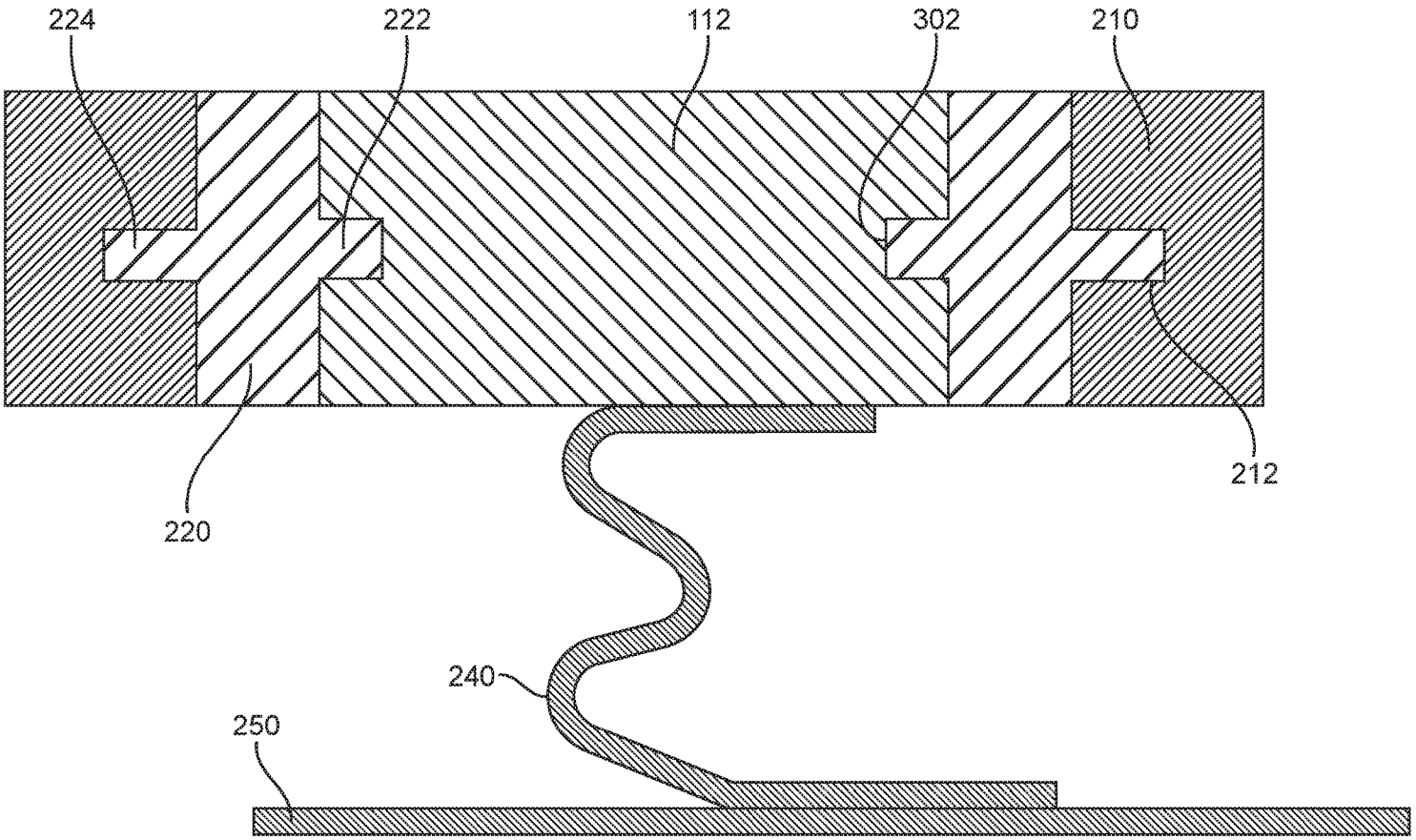
FIG. 4 illustrates a side view of a contact structure according to an embodiment of the present invention.

FIG. 4 illustrates a side view of a contact structure according to an embodiment of the present invention. Contacts 112 may include notches 302. Similarly, frame 210 may include notches 212. Pliable membranes 220 may be formed using insert molding or similar technique to fill notches 302 and 212 with tabs 222 and 224. As before, contact 112 may be electrically connected to traces on board 250 using compliant conductive paths 240.

In various embodiments of the present invention, other interlocking features may be used to secure contacts 112 in place in frame 210. An example is shown in the following figure.

Figure 5:
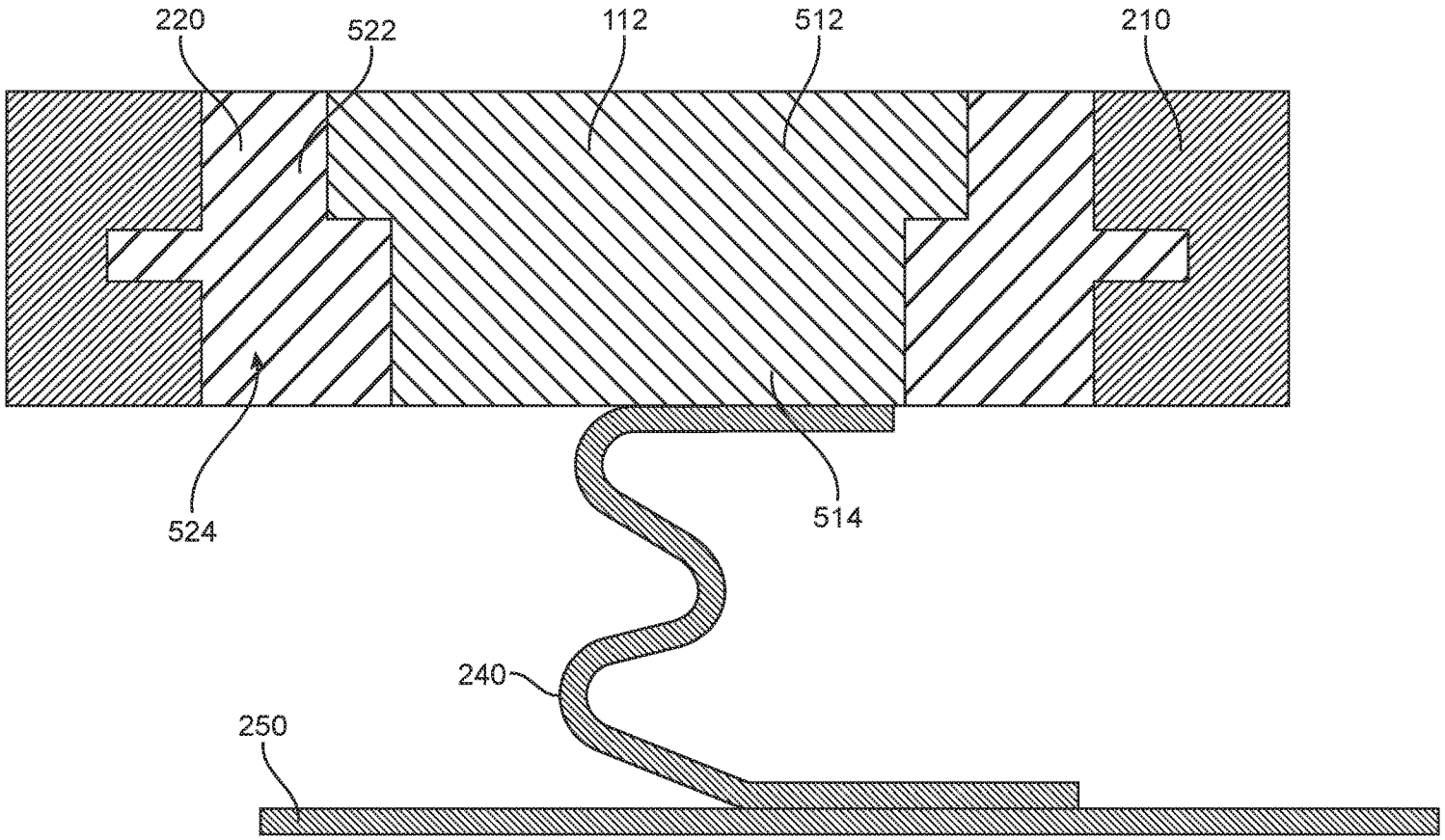
FIG. 5 illustrates a side view of a contact structure according to an embodiment of the present invention.

FIG. 5 illustrates a side view of a contact structure according to an embodiment of the present invention. In this example, contacts 112 may have a wide upper portion 512 and a narrower lower portion 514. Pliable membrane 220 may include a narrow upper portion 522 and a wider lower portion 524. In this way, as a downward force is applied to contact 112, contact 112 is held in place relative to pliable membrane 220.

Frame 210 of the contact structures in these in other embodiments of the present invention may be formed as part of a device enclosure housing an electronic device. In other embodiments the present invention, the device enclosure may have an opening and frame 210 of the contact structure may be placed in that opening. Frame 210 may be secured in the opening in the device housing in various ways. Examples are shown in the following figure.

Figure 6:
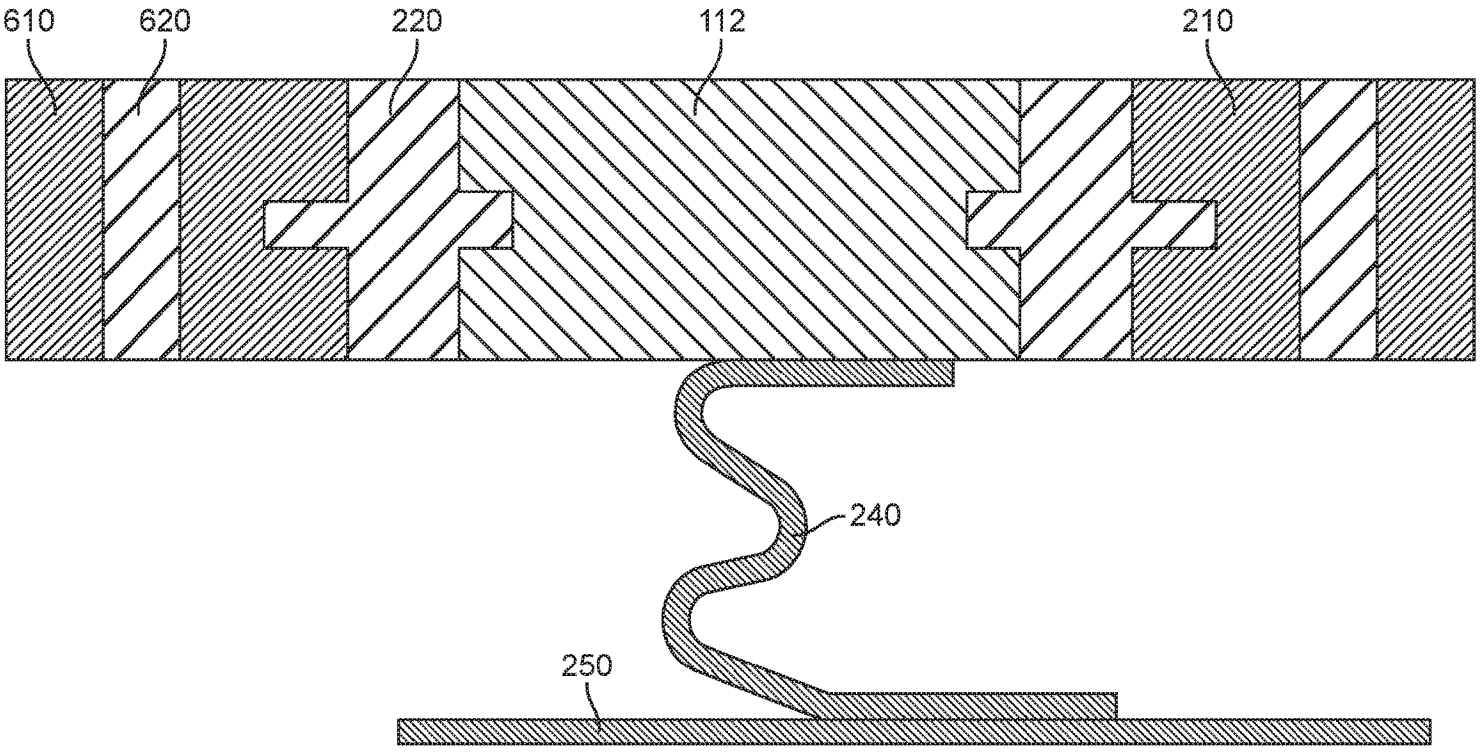
FIG. 6 illustrates a side view of a contact structure in a portion of a device housing according to an embodiment of the present invention.

FIG. 6 illustrates a side view of a contact structure in a portion of a device housing according to an embodiment of the present invention. In this example, contact 112 may be secured to frame 210 by pliable membrane 220. Frame 210 may be secured to housing 610 by membrane 620. Membrane 620 may be rigid or pliable. Membrane 620 may be formed by insert molding or other techniques. Membrane 620, as with membrane 220, may help to prevent the ingress of moisture, debris, or other matter into an electronic device housing this contact structure.

As with contacts 112 in frame 210, interlocking features may be used to secure frame 210 to device housing 610. This may prevent frame 210 from being pushed into the electronic device when contact is made with a second electronic device. An example is shown in the following figure.

Figure 7:
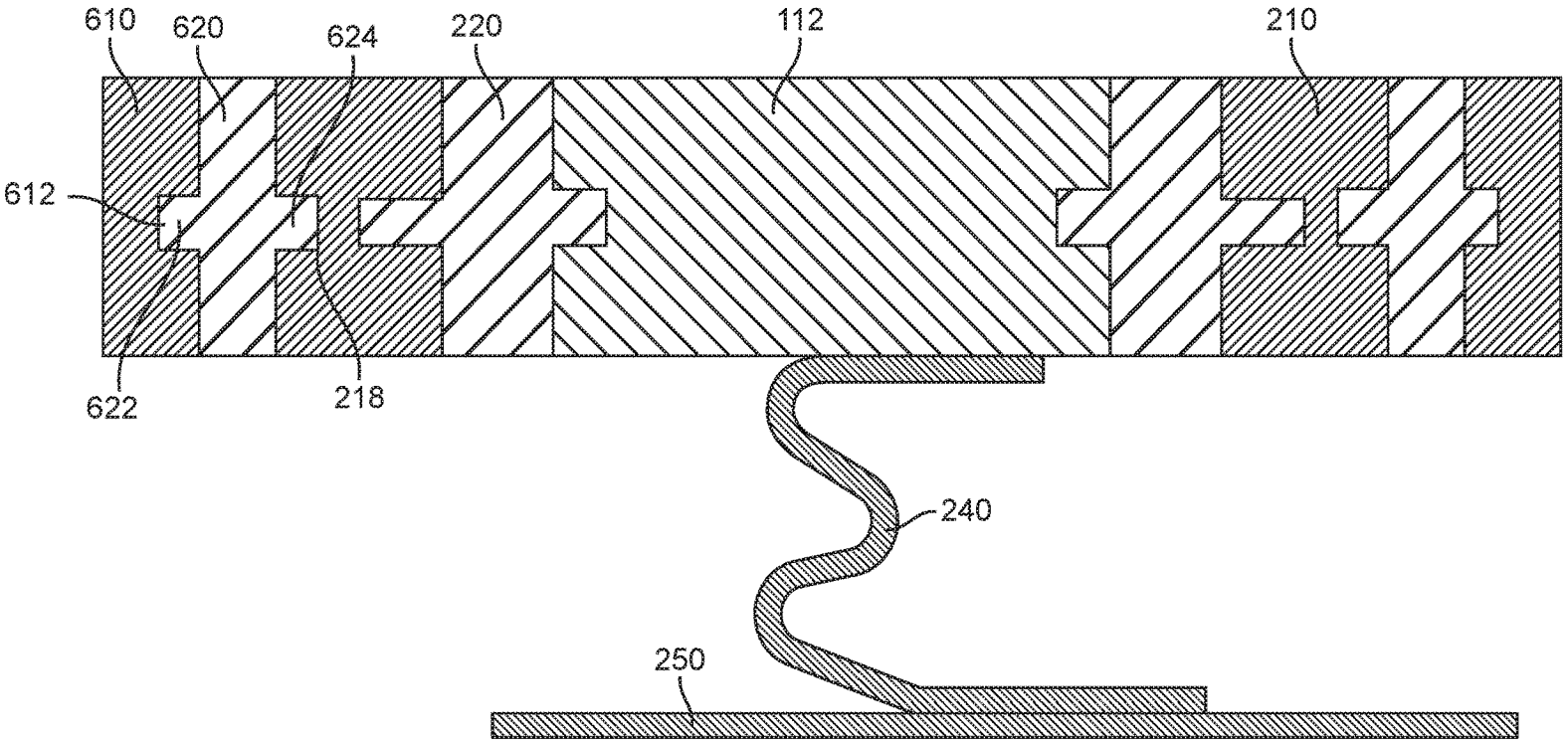
FIG. 7 illustrates a side view of a contact structure and a portion of a device housing according to an embodiment of the present invention.

FIG. 7 illustrates a side view of a contact structure and a portion of a device housing according to an embodiment of the present invention. In this example, frame 210 may include notch 218 in an outside wall. Similarly, device housing 610 may include notch 612 in an inside wall of an opening. Tabs 622 and 624 of membrane 620 may be located in notches 612 and 218. These interlocking features may help to secure frame 210 to device housing 610. As before, contacts 112 may be electrically connected to traces on board 250 through compliant conductive paths 240.

Again, in the above examples, membranes 620 and 220 may be used to provide protection from moisture and particulate or debris ingress into an electronic device. In other embodiments of the present invention, other structures may be used to prevent such ingress. An example is shown in the following figure.

Figure 8:
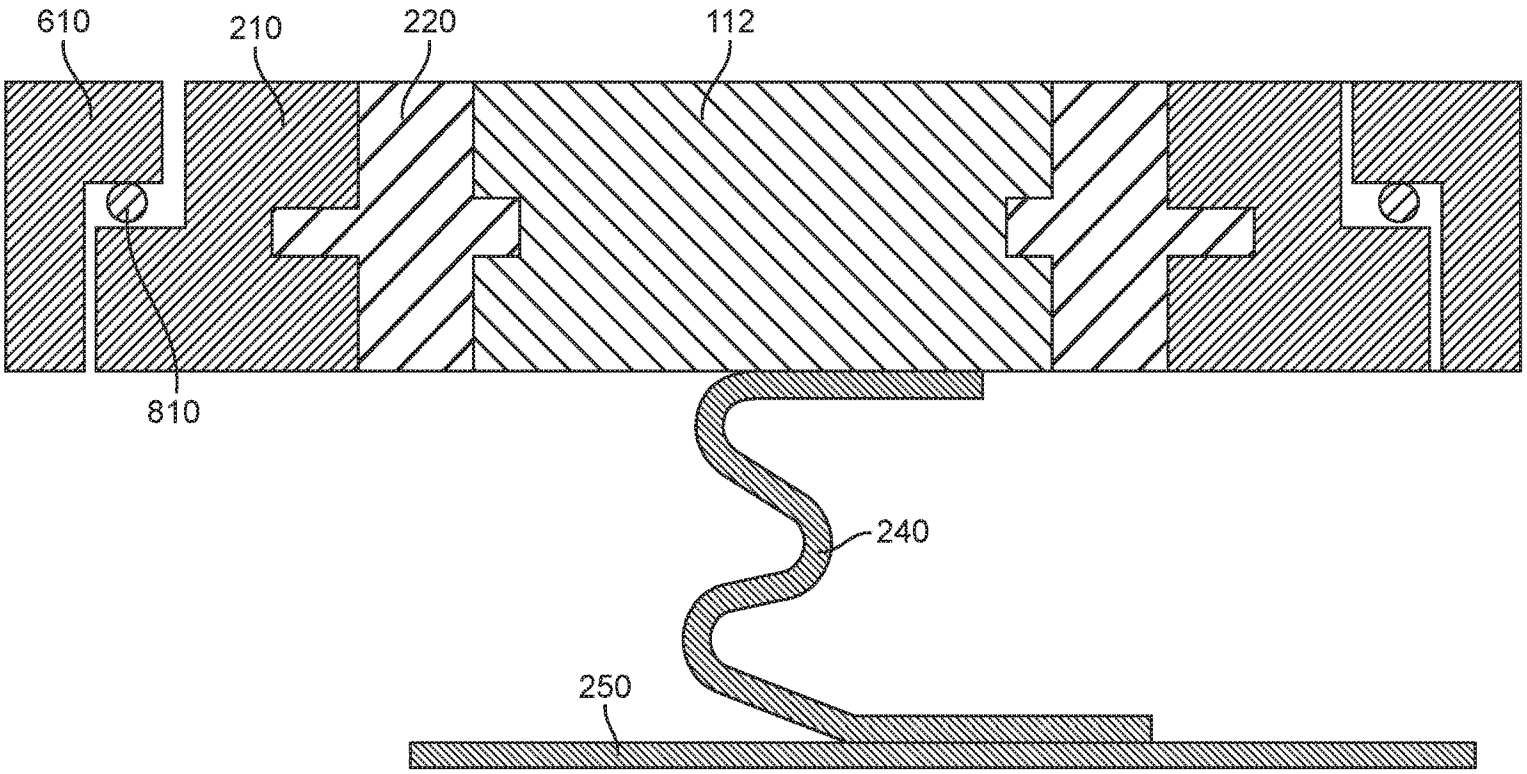
FIG. 8 illustrates a side view of a contact structure in a portion of a device housing according to an embodiment of the present invention.

FIG. 8 illustrates a side view of a contact structure in a portion of a device housing according to an embodiment of the present invention. In this example, frame 210 and device housing 610 may have a gasket or O-ring 810 placed between them. This gasket or O-ring 810 may be secured in place using a glue, silicone, or other adhesive. Gasket or O-ring 810 may provide protection against moisture or debris ingress into an electronic device incorporating this contact structure. As before, contacts 112 may be secured to frame 210 using pliable membranes 220. Contacts 112 may be electrically connected to traces on board 250 using compliant conductive paths 240.

Embodiments of the present invention may provide contact structures that may be located in various types of devices, such as portable computing devices, tablet computers, desktop computers, laptops, all-in-one computers, wearable computing devices, cell phones, smart phones, media phones, storage devices, portable media players, navigation systems, monitors, power supplies, adapters, remote control devices, chargers, and other devices. These devices may include contact structures that may provide pathways for signals and power compliant with various standards such as one of the Universal Serial Bus (USB) standards including USB Type-C, HDMI, DVI, Ethernet, DisplayPort, Thunderbolt, Lightning, JTAG, TAP, DART, UARTs, clock signals, power signals, and other types of standard, non-standard, and proprietary interfaces and combinations thereof that have been developed, are being developed, or will be developed in the future. In one example, the contact structures may be used to convey a data signal, a power supply, and ground.

The above description of embodiments of the invention has been presented for the purposes of illustration and description. It is not intended to be exhaustive or to limit the invention to the precise form described, and many modifications and variations are possible in light of the teaching above. The embodiments were chosen and described in order to best explain the principles of the invention and its practical applications to thereby enable others skilled in the art to best utilize the invention in various embodiments and with various modifications as are suited to the particular use contemplated. Thus, it will be appreciated that the invention is intended to cover all modifications and equivalents within the scope of the following claims.

What is claimed is:

1. A contact structure comprising:

a frame having a plurality of passages from a top of the frame to a bottom of the frame, each passage having an inside edge, wherein the frame is nonconductive;

a plurality of contacts, each contact having a top surface, a bottom surface, and an outside edge-and located in one of the plurality of passages; and a plurality of pliant membranes, each between the outside edge of one of the plurality of contacts and the inside edge of a passage such that at least a portion of a top surface and at least a portion of a bottom surface of the contact are exposed.

2. The contact structure of claim 1 wherein a top surface of each of the plurality of contacts is circular.

3. The contact structure of claim 1 wherein the outside edge of each of the plurality of contacts and an adjacent inside edge of each of the plurality of pliant membranes each comprise first interlocking features that interlock to secure the plurality of contacts in place in the plurality of pliant membranes.

4. The contact structure of claim 3 wherein an outside edge of each of the plurality of pliant membranes and the inside edge of each of the plurality of passages each comprise second interlocking features.

5. The contact structure of claim 4 wherein the first interlocking features include a first notch located circumferentially around the outside edge of each of the plurality of contacts and a first tab on the adjacent inside edge of each of the plurality of pliant membranes.

6. The contact structure of claim 5 wherein the second interlocking features include a second notch located circumferentially around the inside edge of each passage and a second tab on the outside edge of each of the plurality of pliant membranes.

7. The contact structure of claim 6 wherein the frame is formed using one of a liquid crystal polymer (LCP), glass-filled nylon, aluminum, or ceramic.

8. The contact structure of claim 6 wherein the plurality of pliant membranes are formed of silicone or rubber.

9. The contact structure of claim 6 wherein the plurality of pliant membranes are nonconductive.

10. The contact structure of claim 6 wherein the contacts are formed of copper, a copper-nickel alloy, or stainless steel.

11. The contact structure of claim 6 wherein the top surfaces of the contacts are circular, oval, or square.

12. The contact structure of claim 1 further comprising a plurality of compliant conductive paths, each from one of the plurality of contacts to a board.

13. The contact structure of claim 12 wherein each of the plurality of compliant conductive paths are a wire, spring, or spring-loaded contact.

14. The contact structure of claim 1 wherein the frame is part of a device enclosure for an electronic device housing the contact structure.

15. An electronic device comprising:

a housing, the housing having an opening, the opening having an inside edge; and a contact structure located in the opening in the housing and comprising:

a frame having an outside edge and further having a plurality of passages from a top of the frame to a bottom of the frame, each passage having an inside edge;

a plurality of contacts, each contact having a top surface, a bottom surface, and an outside edge, and located in one or the plurality of passages; and a plurality of first pliant membranes, each between an outside edge of one of the plurality of contacts and an inside edge of a passage such that at least a portion of a top surface and at least a portion of a bottom surface of the contact are exposed, wherein the outside edge of each of the plurality of contacts and adjacent inside edges of the plurality of first pliant membranes each comprise interlocking features that interlock to secure the plurality of contacts in place in the plurality of first pliant membranes.

16. The electronic device of claim 15 wherein the frame is nonconductive.

17. The electronic device of claim 15 further comprising an insert molded membrane between the inside edge of the opening in the housing and the outside edge of the frame.

18. The electronic device of claim 15 further comprising a second pliant membrane between the inside edge of the opening in the housing and the outside edge of the frame.

19. The electronic device of claim 15 wherein the interlocking feature on the outside edge of each of the plurality of contacts comprises a first notch located circumferentially around the contact.

20. The electronic device of claim 19 wherein the interlocking feature on the adjacent inside edge of each of the plurality of first pliant membranes includes a first tab to fit in the first notch in the outside edge of each contact.

21. The electronic device of claim 20 wherein the inside edge of each passage includes a second notch and each first pliant membrane has a second tab to fit in the second notch in the inside edge of each passage.

22. The electronic device of claim 21 wherein the inside edge of the opening in the housing and the outside edge of the frame include interlocking features to secure the frame in place in the housing.

23. A contact structure comprising:

a frame having a plurality of passages from a top of the frame to a bottom of the frame, each passage having an inside edge;

a plurality of contacts, each contact having a top surface, a bottom surface, and an outside edge and located in one or the plurality of passages; and a plurality of pliant membranes, each between an outside edge of one of the plurality of contacts and an inside edge of a passage such that at least a portion of a top surface and at least a portion of a bottom surface of the contact are exposed, wherein the outside edge of each of the plurality of contacts and adjacent inside edges of the plurality of pliant membranes comprise interlocking features that interlock to prevent the plurality of contacts from being pushed out of the plurality of pliant membranes.

24. The contact structure of claim 23 wherein a top surface of each of the plurality of contacts is circular.

25. The contact structure of claim 23 wherein the frame is nonconductive.

26. The contact structure of claim 23 wherein the interlocking feature on the outside edge of each of the plurality of contacts comprises a first notch located circumferentially around the contact.

27. The contact structure of claim 26 wherein the interlocking feature on the adjacent inside edge of each of the plurality of pliant membranes includes a first tab to fit in the first notch in the outside edge of each contact.

* * * * *